US008876359B2

(12) United States Patent
Orritt et al.

(10) Patent No.: US 8,876,359 B2
(45) Date of Patent: Nov. 4, 2014

(54) ELECTRICALLY ISOLATING LAMP ASSEMBLY

(75) Inventors: Chris Orritt, Wigan (GB); Richard Joshi, Wigan (GB)

(73) Assignee: ATG R&D Limited, Wigan (GB)

( * ) Notice: Subject to any disclaimer, the term of this patent is extended or adjusted under 35 U.S.C. 154(b) by 235 days.

(21) Appl. No.: 13/467,803

(22) Filed: May 9, 2012

(65) Prior Publication Data

US 2013/0301282 A1 Nov. 14, 2013

(51) Int. Cl.
*F21V 21/00* (2006.01)

(52) U.S. Cl.
CPC ..... *F21V 21/00* (2013.01)
USPC ..... 362/655; 362/647; 362/396; 362/457; 439/318; 439/699.2

(58) Field of Classification Search
USPC ..... 362/547, 655, 652, 656, 396, 457; 439/318, 321, 619, 699.2
See application file for complete search history.

(56) References Cited

U.S. PATENT DOCUMENTS 4,100,448 A * 7/1978 Chipner et al. ..... 313/318.11
4,760,506 A * 7/1988 Mochizuki et al. ..... 362/548
4,841,419 A * 6/1989 Ohishi ..... 362/656
5,893,632 A * 4/1999 Kusagaya et al. ..... 362/655
8,616,785 B2 * 12/2013 Carpenter et al. ..... 385/89

FOREIGN PATENT DOCUMENTS

EP 1 348 902 A1 10/2003
EP 2 202 852 A2 6/2010

OTHER PUBLICATIONS

Complete file wrapper of Applicants related European Application EP2662938 (A1) —Nov. 13, 2013, including the European Search Report (Sep. 17, 2013) & opinion.

* cited by examiner

*Primary Examiner* — Laura Tso
(74) *Attorney, Agent, or Firm* — Ronald J. Koch

(57) ABSTRACT

An electrically isolating lamp assembly comprises a clamp ring, a lamp end, and a socket, wherein the lamp end is positioned within the clamp ring and the lamp end can be rotated, relative to the clamp ring, between locked and unlocked positions. In the unlocked position, lamp end shoulders are radially non-aligned with clamp ring flanges, and a locking peg is restrained, by the clamp ring flange, from being inserted completely within a locking peg channel in the lamp end, whereby the socket is restrained from fully engaging the lamp end; in the locked position, the lamp end shoulders are radially aligned with the clamp ring flanges, and the locking peg is inserted completely within the locking peg channel, whereby the socket can fully engage the lamp end, and wherein the lamp end is restrained by the locking peg from being rotated to the unlocked position.

2 Claims, 6 Drawing Sheets

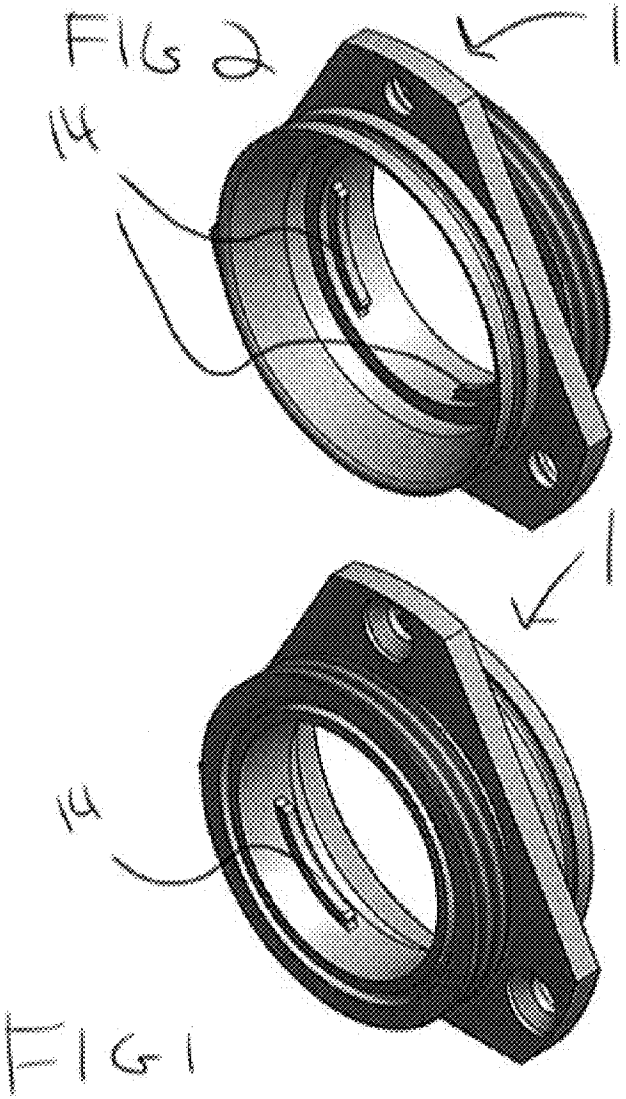
FIG 2
FIG 1
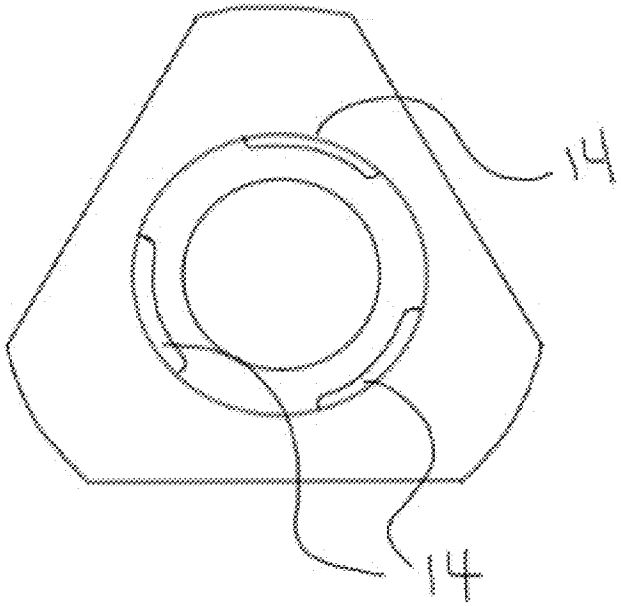
FIG 3

17

5
4
18

FIG 17
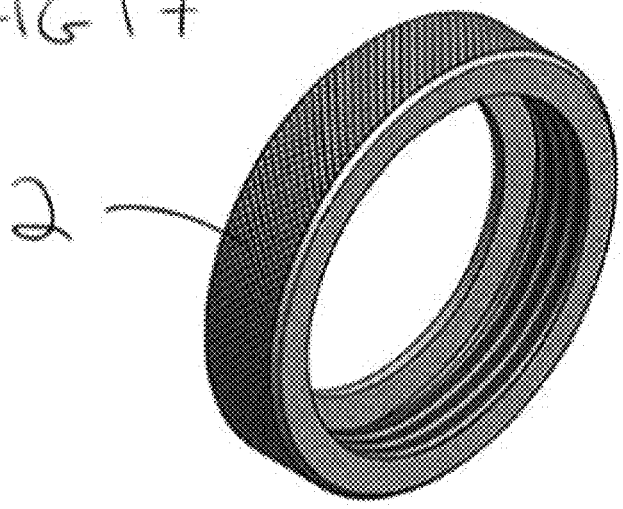
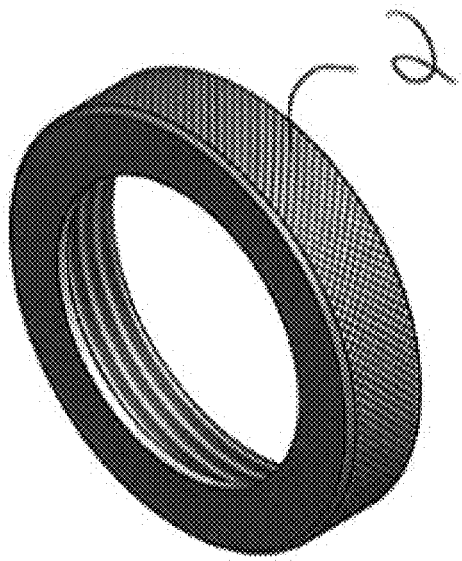
FIG 16

ELECTRICALLY ISOLATING LAMP ASSEMBLY

CROSS REFERENCE TO RELATED APPLICATIONS

Not Applicable

FEDERALLY SPONSORED RESEARCH

Not Applicable

SEQUENCE LISTING, TABLE, OR COMPUTER PROGRAM COMPACT DISK APPENDIX

Not Applicable

CLAIM OF PRIORITY BASED ON COPENDING APPLICATION claims benefit of Not Applicable

BACKGROUND AND SUMMARY

The present invention relates generally to UV Lamp systems and specifically to electrical connecting means for said systems.

Conventional ultra-violet (UV) Lamp systems are problematic due to an unacceptably high risk of electrical shock, burn, and exposure to UV-C radiation inherent in the design of such systems. Removal of a UV lamp while energized exposes the operator to UV light radiation, extreme heat, and potential electrical shock.

Conventional solutions to the problem do not completely eliminate the inherent risks. One such system utilizes a large electrical enclosure with an access port. This system does not completely mitigate the risks because the access port could be carelessly left open. Another system utilizes a mechanical trip switch to de-energize the lamp upon removal. This system also fails to completely mitigate the risks because the switch can fail.

The present invention provides a solution to the foregoing problems completely mitigating the inherent risks wherein a clamp ring having three clamp ring flanges circumferentially spaced evenly about the inside of the clamp ring; a lamp end comprising, a base, three lamp end shoulders circumferentially spaced evenly about the lamp end base near a proximal edge of the lamp end, a lamp end ridge on a distal edge of the lamp end, and a locking peg channel originating on the distal edge of the lamp end and disposed longitudinally along the lamp end base; a socket having a locking peg extending outwardly therefrom; wherein the lamp end is positioned within the clamp ring and the lamp end can be rotated, relative to the clamp ring, between locked and unlocked positions as the lamp end ridge abuts the clamp ring flanges; further wherein, in the unlocked position, the lamp end shoulders are radially interposed between the clamp ring flanges, and the locking peg is restrained, by any one of the clamp ring flanges, from being inserted completely within the locking peg channel, whereby the socket is restrained from fully engaging the lamp end; further wherein, in the locked position, the lamp end shoulders are radially aligned with the clamp ring flanges, and the locking peg is inserted completely within the locking peg channel, whereby the socket can fully engage the lamp end, and wherein the lamp end is restrained by the locking peg from being rotated to the unlocked position.

BRIEF DESCRIPTION OF THE DRAWINGS

FIG. 1 depicts a perspective view of clamp ring 1
FIG. 2 depicts a perspective view of clamp ring 1
FIG. 3 depicts a plan view of clamp ring 1
FIG. 6 depicts a perspective view of lamp end 9
FIG. 16 depicts a perspective view of retainer 2
FIG. 17 depicts a perspective view of retainer 2

DETAILED DESCRIPTION

Figures 4, 5:
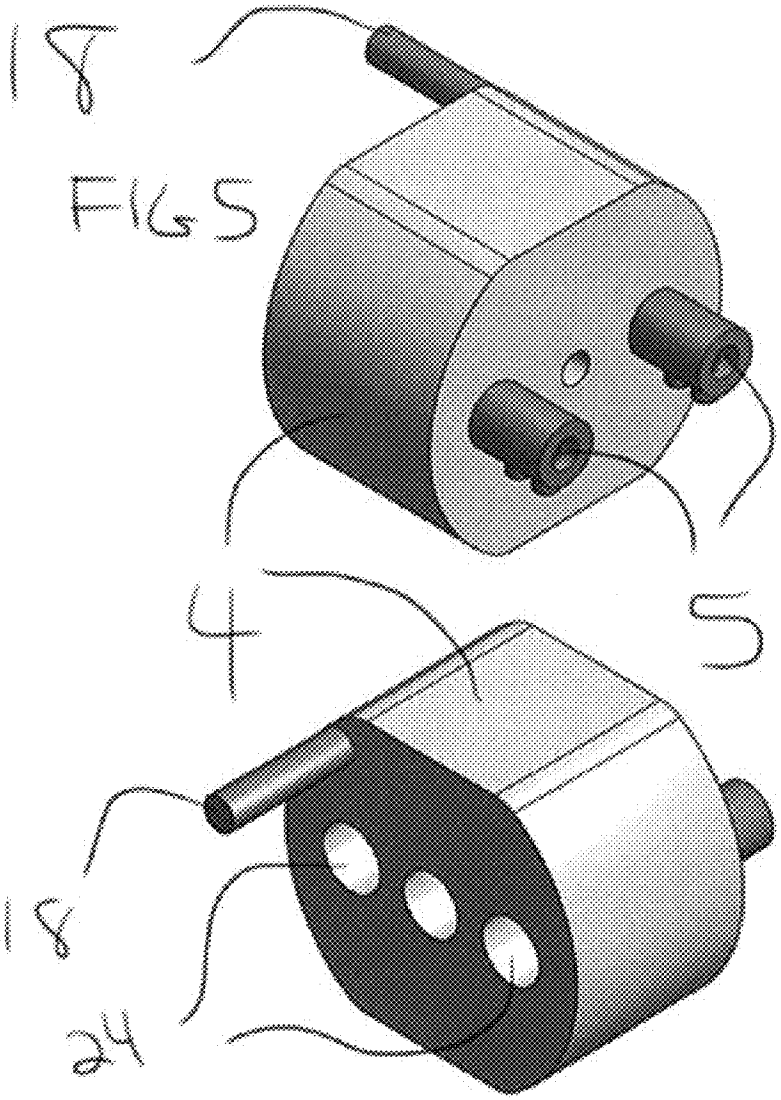
FIG. 4 depicts a perspective view of socket 4
FIG. 5 depicts a perspective view of socket 4
Figure 7:
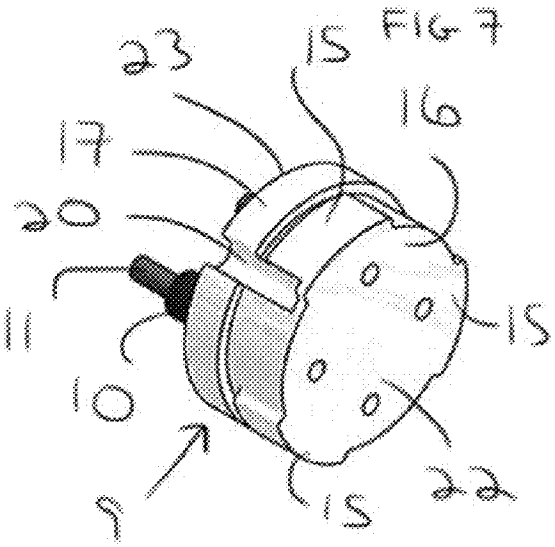
FIG. 7 depicts a perspective view of lamp end 9
Figure 9:
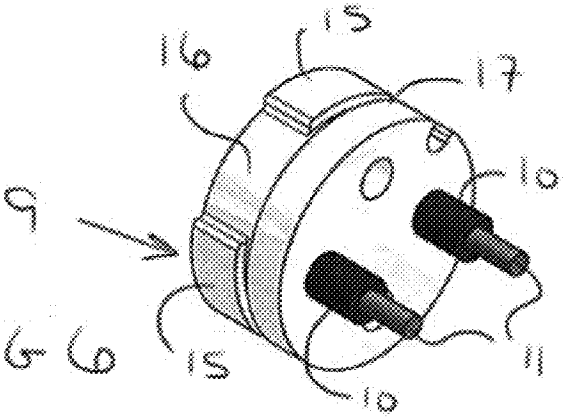
FIG. 9 depicts a frontal view of lamp end 9
Figure 8:
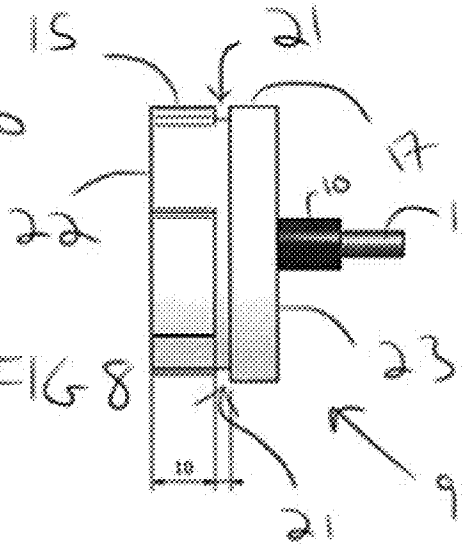
FIG. 8 depicts a side view of lamp end 9
Figure 9:
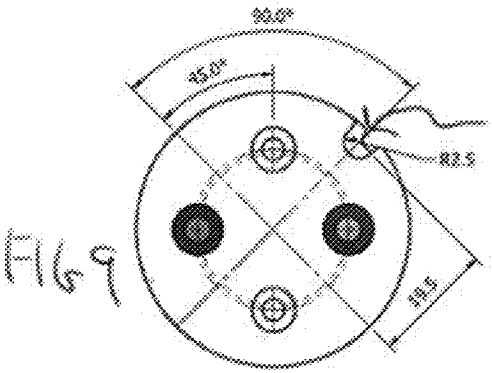
Figure 10:
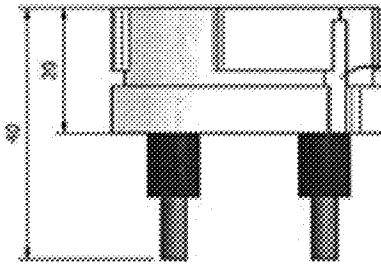
FIG. 10 depicts a top view of lamp end 9
Figure 11:
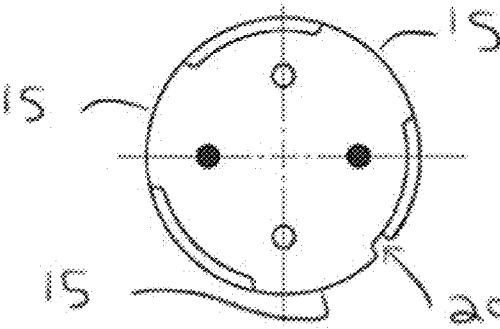
FIG. 11 depicts a rear view of lamp end 9
Figure 13:
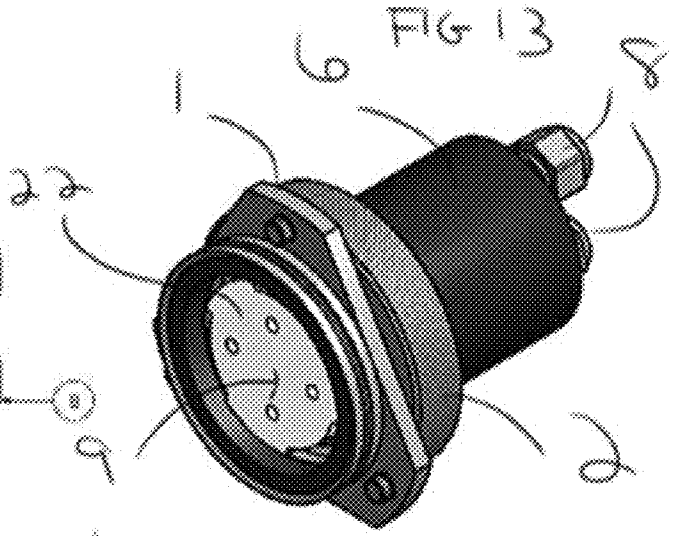
FIG. 13 depicts a perspective view of one embodiment of the invention
Figure 12:
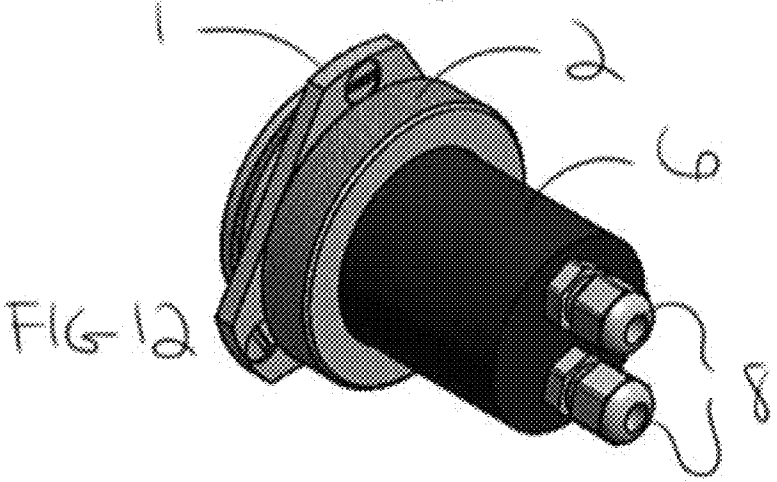
FIG. 12 depicts a perspective view of one embodiment of the invention
Figure 14:
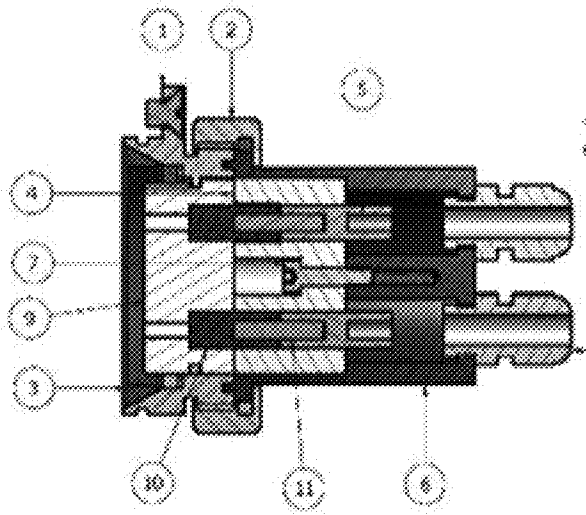
FIG. 14 depicts a side cutaway view of one embodiment of the invention
Figure 15:
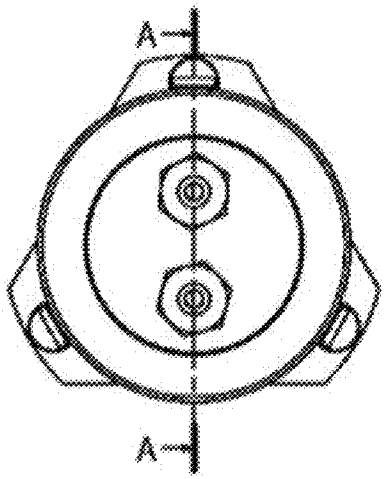
FIG. 15 depicts a frontal view of one embodiment of the invention
Figures 18, 19:
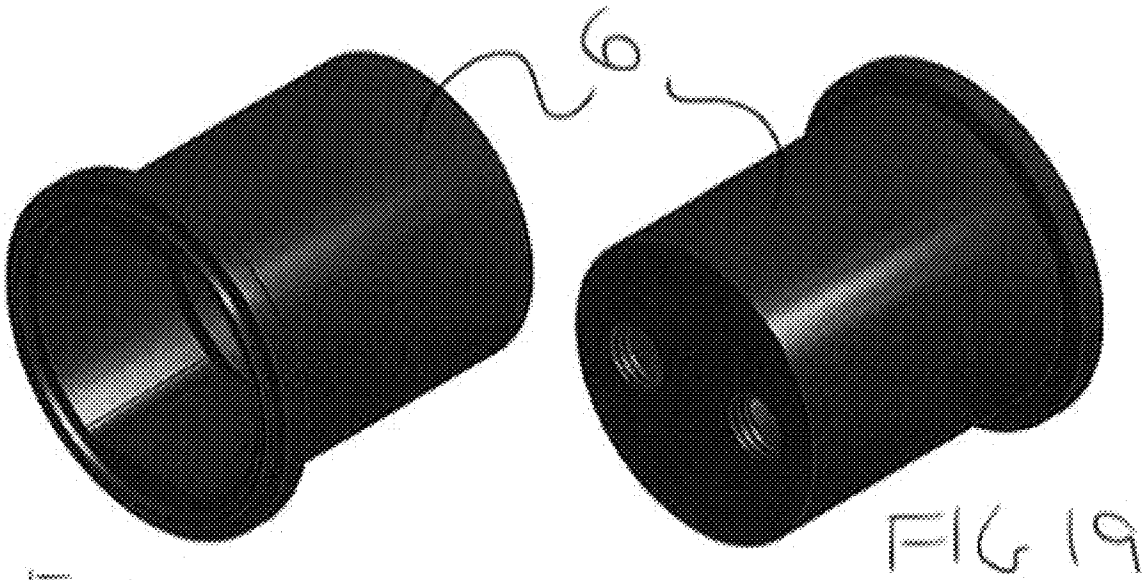
FIG. 18 depicts a perspective view of socket cover 6
FIG. 19 depicts a perspective view of socket cover 6

In one embodiment, electrically isolating lamp assembly 19 comprises, clamp ring 1 having three clamp ring flanges 14 circumferentially spaced evenly about the inside of clamp ring 1; lamp end 9 having, base 16, three lamp end shoulders 15 circumferentially spaced evenly about lamp end base 16 near proximal edge 22 of lamp end 9, lamp end ridge 17 on distal edge 23 of lamp end 9, and locking peg channel 20 originating at distal edge 23 of lamp end 9, and disposed longitudinally along lamp end base 9; and socket 4 having locking peg 18 extending outwardly therefrom, electrical pin sockets 5, and openings 24.

Lamp end ridge 17 extends entirely around the periphery of lamp end 9. Notch 21 of lamp end 9 is formed by lamp end ridge 17 and lamp end shoulders 15. Lamp end shoulders 15 do not extend longitudinally along the entire length of lamp end 9. Thus, notch 21 is formed. In the locked position, clamp ring flanges 14 are restrained within notch 21 thus locking lamp end 9 from being removed from claim ring 1.

Lamp end assembly 12 comprises lamp end 9, electrical pins 11, and electrical pin spacers 10. Lamp connector assembly 13 comprises socket 4, retainer 2, socket cover 6, socket head bolt 7, and glands 8. Lamp end 9 is positioned within clamp ring 1 and can be rotated, relative to clamp ring 1, between locked and unlocked positions as lamp end ridge 17 abuts clamp ring flanges 14 defining a fully inserted position.

In the unlocked position, lamp end shoulders 15 are radially interposed between clamp ring flanges 14, and locking peg 18 is restrained, by any one of clamp ring flanges 14, from being inserted completely within locking peg channel 20, whereby socket 4 is restrained from fully engaging lamp end 9.

In the locked position, lamp end shoulders 15 are radially aligned with clamp ring flanges 14, and locking peg 18 is inserted completely within locking peg channel 20, whereby socket 4 can fully engage lamp end 9 (electrical pins 11 fitting within openings 24).

In the locked position, lamp end 9 is positioned within clamp ring 1 and lamp end ridge 17 abuts clamp ring flanges 14 defining a fully inserted position, locking peg channel 20 is long enough to extend beyond clamp ring flanges 14 so that clamp ring flanges 14 are restrained by locking peg 18 such that lamp end 9 cannot be rotated to the unlocked position (necessary for removal of lamp end 9 from being fully inserted within clamp ring 1).

A distinct advantage of the present invention is therefore achieved because the lamp (connected to lamp end 9) cannot be removed from its enclosure when the lamp is energized.

In one embodiment, only one lamp end shoulder 15 and one clamp ring flange 14 is used wherein lamp end shoulder 15 extends entirely around the periphery of lamp end base 16 except for a void equaling the width of clamp ring flange 14.

What is claimed is:

1. An electrically isolating lamp assembly comprising:

a clamp ring having three clamp ring flanges circumferentially spaced evenly about the inside of the clamp ring;

a lamp end comprising, a base, three lamp end shoulders circumferentially spaced evenly about the lamp end base near a proximal edge of the lamp end, a lamp end ridge on a distal edge of the lamp end, and a locking peg channel originating on the distal edge of the lamp end and disposed longitudinally along the lamp end base;

a socket having a locking peg extending outwardly therefrom;

wherein the lamp end is positioned within the clamp ring and the lamp end can be rotated, relative to the clamp ring, between locked and unlocked positions as the lamp end ridge abuts the clamp ring flanges;

further wherein, in the unlocked position, the lamp end shoulders are radially interposed between the clamp ring flanges, and the locking peg is restrained, by any one of the clamp ring flanges, from being inserted completely within the locking peg channel, whereby the socket is restrained from fully engaging the lamp end;

further wherein, in the locked position, the lamp end shoulders are radially aligned with the clamp ring flanges, and the locking peg is inserted completely within the locking peg channel, whereby the socket can fully engage the lamp end, and wherein the lamp end is restrained by the locking peg from being rotated to the unlocked position.

2. An electrically isolating lamp assembly comprising:

a clamp ring having a clamp ring flange disposed about the inside of the clamp ring;

a lamp end comprising, a base, a lamp end shoulder disposed about the lamp end base near a proximal edge of the lamp end, a lamp end ridge on a distal edge of the lamp end, and a locking peg channel originating on the distal edge of the lamp end and disposed longitudinally along the lamp end base;

a socket having a locking peg extending outwardly therefrom;

wherein the lamp end is positioned within the clamp ring and the lamp end can be rotated, relative to the clamp ring, between locked and unlocked positions as the lamp end ridge abuts the clamp ring flange;

further wherein, in the unlocked position, the lamp end shoulder is radially non-aligned with the clamp ring flange, and the locking peg is restrained, by the clamp ring flange, from being inserted completely within the locking peg channel, whereby the socket is restrained from fully engaging the lamp end;

further wherein, in the locked position, the lamp end shoulder is radially aligned with the clamp ring flange, and the locking peg is inserted completely within the locking peg channel, whereby the socket can fully engage the lamp end, and wherein the lamp end is restrained by the locking peg from being rotated to the unlocked position.

* * * * *